US005330580A

United States Patent [19]

Whipple, III et al.

[11] Patent Number: 5,330,580

[45] Date of Patent: * Jul. 19, 1994

[54] DISHWASHER INCORPORATING A CLOSED LOOP SYSTEM FOR CONTROLLING MACHINE LOAD

[75] Inventors: Walter Whipple, III, Amsterdam, N.Y.; David A. Schneider; Gregory O. Miller, both of Louisville, Ky.; Mark E. Dausch; Vivek V. Badami, both of Schenectady, N.Y.

[73] Assignee: General Electric Company, Schenectady, N.Y.

[ * ] Notice: The portion of the term of this patent subsequent to Feb. 8, 2011 has been disclaimed.

[21] Appl. No.: 877,304

[22] Filed: May 1, 1992

[51] Int. Cl.[5] ..... B08B 3/02; B08B 7/04

[52] U.S. Cl. ..... 134/18; 134/25.2; 134/57 D

[58] Field of Search ..... 134/10, 18, 25.2, 25.3, 134/25.4, 57 D; 68/12.02, 12.19; 8/159

[56] References Cited

U.S. PATENT DOCUMENTS

| | | | |
|---|---|---|---|
| 3,359,766 | 12/1967 | Haas | 68/207 |
| 3,478,373 | 3/1968 | McBride et al. | 8/158 |
| 3,508,287 | 2/1968 | Mason | 8/158 |
| 4,097,307 | 6/1978 | Geiger | 134/10 |
| 4,481,786 | 11/1984 | Bashark | 68/12.19 |
| 4,697,293 | 10/1987 | Knoop | 8/158 |
| 4,741,357 | 5/1988 | Battel et al. | 137/387 |
| 4,835,991 | 6/1989 | Knoop et al. | 68/12 R |
| 4,950,969 | 8/1990 | Getz | 68/12.16 |
| 5,161,110 | 11/1992 | Dorchak | 364/468 |

FOREIGN PATENT DOCUMENTS

| | | | |
|---|---|---|---|
| 3803006 | 2/1988 | Fed. Rep. of Germany . | |
| 2577788 | 8/1986 | France | 134/57 D |
| 61185298 | 2/1985 | Japan . | |
| 01146579 | 12/1987 | Japan . | |
| 02074291 | 9/1988 | Japan . | |
| 1274797 | 11/1989 | Japan . | |
| 2077296 | 3/1990 | Japan | 68/12.02 |

OTHER PUBLICATIONS

"Home Appliances", Chap. 16 of *Sensors: A Comprehensive Survey*, vol. 1, edited by W. Gopel, J. Hesse, and J. N. Zemel (1989).

"Invisible at Home, Fuzzy Logic Crosses the Pacific and Bursts Out All Over", published by Computergram International on Feb. 5, 1991.

"WCI Differentiates its Brands: Presents Restyled Lines Aimed at Specific Retail Channels: WCI Appliance Group", published by the Weekly Home Furnishings Newspaper on Feb. 4, 1991.

"The Future of Electronics Looks 'Fuzzy'", published in The Washington Post on Dec. 23, 1990.

"Fuzzy Logic" published in Popular Science in Jul. 1990.

*Primary Examiner*—Richard O. Dean
*Assistant Examiner*—Saeed T. Chaudhry
*Attorney, Agent, or Firm*—Marvin Snyder

[57] ABSTRACT

A machine, such as a dishwasher or clothes washer, incorporates a device for measuring machine load that includes a sensor for detecting power consumption surges. The machine may further include a frame for containing articles, a power utilization system for circulating or distributing a liquid in the frame, and a controller, responsive to the device, for controlling the amount of liquid provided to the frame.

14 Claims, 5 Drawing Sheets

DISHWASHER INCORPORATING A CLOSED LOOP SYSTEM FOR CONTROLLING MACHINE LOAD

RELATED APPLICATIONS

This application is related to patent application Ser. No. 07/877,310 (RD-22,122), entitled "Sensor Holder for a Machine for Cleansing Articles" by Dausch et al., filed May 1, 1992, patent application Ser. No. 07/877,303 (RD-21,521), entitled "Machine for Cleansing Articles," by Molnar et al., filed May 1, 1992, patent application Ser. No. 07/877,300 (RD-21,353), entitled "Fluid-Handling Machine Incorporating a Closed Loop System for Controlling Liquid Load," by Dausch et al., filed May 1, 1992, patent application Ser. No. 07/877,301 (RD-22,082), entitled "A Fuzzy Logic Control Method for Reducing Water Consumption in a Machine for Washing Articles," by Badami et al., filed May 1, 1992, patent application Ser. No. 07/877,305 (RD-22,061), entitled "A Fuzzy Logic Control Method for Reducing Energy Consumption in a Machine for Washing Articles," by Dausch et al., filed May 1, 1992, and patent application Ser. No. 07/877,305 (RD-21,519), entitled "Device for Monitoring Load," by Whipple, III, filed May 1, 1992. The aforesaid patent applications are assigned to the assignee of the present invention and herein incorporated by reference.

FIELD OF THE INVENTION

The invention relates to a method and apparatus for controlling electrical or mechanical load. More particularly, the invention relates to a closed loop system for fluid-handling apparatus providing feedback control.

BACKGROUND OF THE INVENTION

Reducing the amount of energy consumption by a fluid-handling machine for cleansing articles, such as a clothes washer, is a significant problem, in part because of increasing worldwide energy demand. In such a machine, the amount of energy consumed is primarily determined by the amount of energy needed to heat the liquid, such as water, used to cleanse the articles. Thus, decreased liquid consumption for such machines can result in a significant improvement in energy efficiency.

Appliances for cleansing articles, such as clothes washers, typically receive liquid for a predetermined duration through a conduit connected to the machine. A wash cycle for a machine for cleansing articles may comprise providing substantially particle-free liquid to the machine, circulating or distributing the liquid during the wash cycle, and draining or flushing the liquid from the machine after being used to wash the articles. Typically, a machine user has limited control over the amount of liquid provided for a wash cycle, such as by selection from a few predetermined options. Such a machine does not use liquid efficiently because variations in liquid pressure or degradation in machine components generally require providing liquid for an excessive duration to ensure a more than sufficient amount for a wash cycle. Closed loop feedback control is one method to improve water conservation in clothes washers. Several devices are available to monitor or measure the amount or volume of liquid provided for a wash cycle.

Devices for measuring the amount of liquid, such as water, provided to a machine for cleansing articles include flowmeters that measure the water flow rate to the clothes washer and water level sensors that detect the static air pressure in an air cavity in the sensor. However, such devices may be difficult or non-economic to implement, may be unreliable, may degrade over time, and may not provide robust measurements relative to the machines incorporating them. Furthermore, the accuracy of such devices is not entirely satisfactory due to variations in the amount of liquid needed to satisfactorily cleanse varying amounts of soiled articles.

A need thus exists for a machine for cleansing articles incorporating a closed loop feedback system for monitoring and controlling the amount of liquid provided for a wash cycle.

SUMMARY OF THE INVENTION

One object of the invention is to provide a closed loop feedback control system incorporating a machine load measuring device and a machine including such a system.

Another object is to provide a machine load measuring device capable of being used in a fuzzy logic feedback control system providing either periodic or continuous closed loop feedback control, and a machine including such a device and fuzzy logic feedback control system.

An additional object is to provide a machine load measuring device and closed loop feedback control system that is both more accurate and more reliable than those currently available, and a machine that includes such a system.

In accordance with the invention, a machine, such as a dishwasher or clothes washer, incorporates a device for measuring machine load that includes a sensor for detecting power consumption surges. The machine may further include a frame for containing articles, a power utilization system for circulating or distributing a liquid in the frame, and a controller, responsive to the device, for controlling the amount of liquid provided to the frame.

BRIEF DESCRIPTION OF THE DRAWINGS

The subject matter regarded as the invention is particularly pointed out and distinctly claimed in the concluding portion of the specification. The invention, however, both as to organization and method of operation, together with further objects and advantages thereof, may best be understood by reference to the following detailed description when read with the accompanying drawings in which:

DETAILED DESCRIPTION OF THE INVENTION

Figure 1:
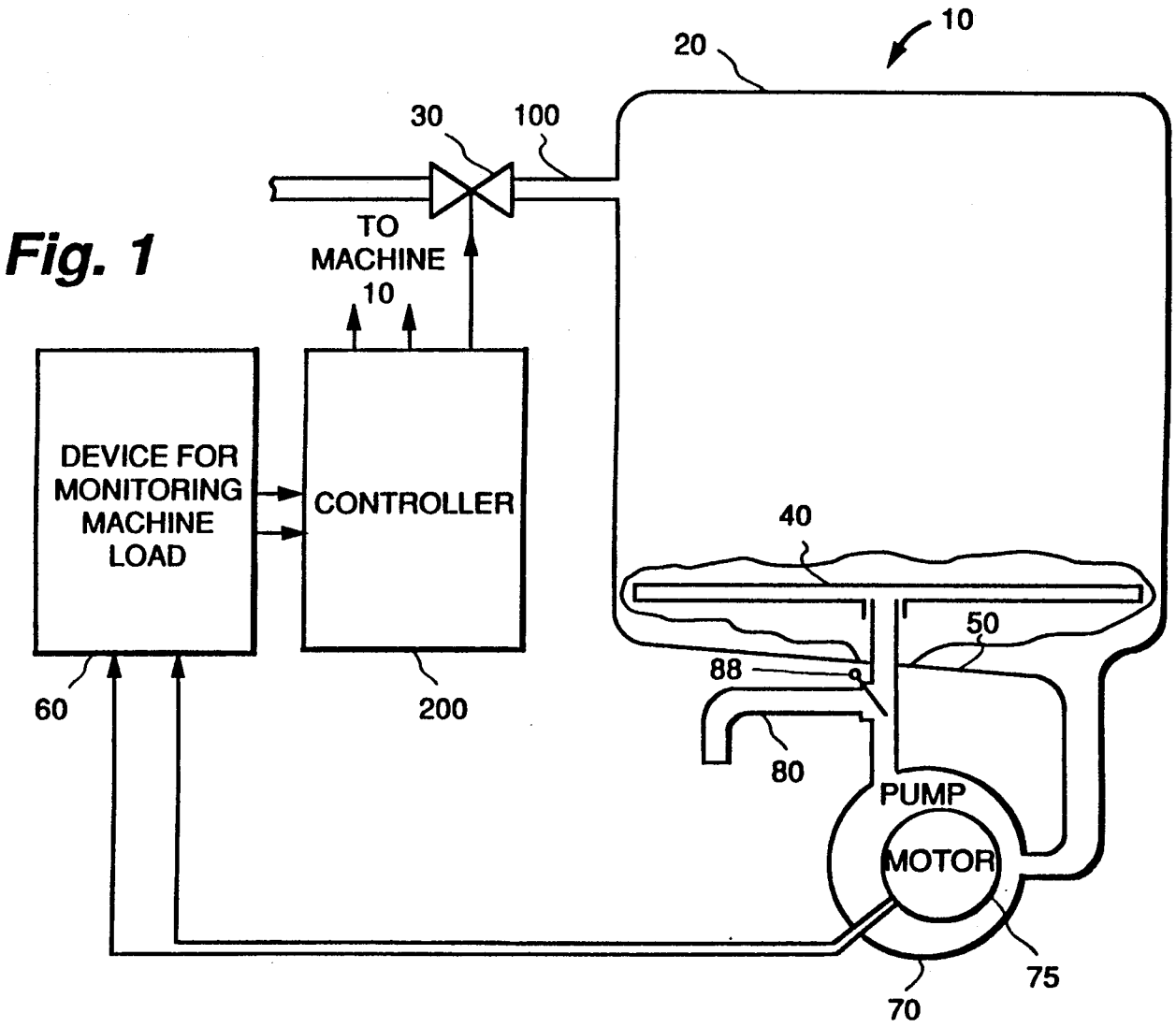
FIG. 1 is a schematic diagram of a machine incorporating a closed loop system for controlling machine load in accordance with the invention.

FIG. 1 illustrates a machine 10, which comprises, in combination, a frame 20 for containing articles, a system for providing liquid to frame 20, such as a conduit 100 connected to frame 20 through an aperture in the frame, a pump 70, driveably coupled to a motor 75, for circulating or distributing liquid in the frame, a device 60 for monitoring or measuring machine load as frame 20 receives liquid, and a controller 200 responsive to device 60, for controlling a valve 30 in conduit 100.

The specific configuration of a machine, such as machine 10 for cleansing articles, depends in part on the type of machine, such as a dishwasher. For example, as illustrated in FIG. 1, machine 10 includes: a subsystem to distribute or circulate liquid, which may include a sump 50 of frame 20, a spray arm 40 rotatably connected to, and in liquid communication with, a pump 70, and the pump; a subsystem to provide substantially particle-free liquid, which may include conduit 100 connected to frame 20 through an aperture in the frame, and valve 30 incorporated in conduit 100; and a subsystem to remove liquid, which may include sump 50, pump 70 and an outlet 80. As indicated, pump 70 is driven by apparatus, such as motor 75. Valve 88 is a standard valve that may be actuated to direct the flow of liquid to spray arm 40 or, alternatively, outlet 80. Although FIG. 1 illustrates an embodiment of the invention in which a liquid, such as water, is distributed in a machine for cleansing articles, such as food handling items, the invention is not restricted in scope to this embodiment.

Device 60 for monitoring machine load is shown in FIG. 1 as receiving one or more signals from motor 75 and providing one or more signals to controller 200. Device 60 includes a sensor for detecting the power consumption surges of motor 75 as frame 20 receives liquid though conduit 100. Motor 75 consumes power to distribute or circulate liquid in frame 20. In the context of the invention, machine load refers to the power consumed by the driving apparatus in the machine, such as motor 75. Likewise, power consumption surges refers to substantial changes in power consumption when machine load is changing. For the embodiment of the invention illustrated in FIG. 1, liquid load refers to the amount of liquid being circulated or distributed in machine 10 during a wash cycle. Liquid load is defined relative to a sufficient amount of liquid for a particular wash cycle; however, in a given situation the liquid load may exceed this sufficient amount or it may be less than this sufficient amount. For the embodiment illustrated in FIG. 1, motor load refers to the power consumed by motor 75 to distribute or circulate a given liquid load in the machine and is substantially the same load as machine load.

Device 60 may include any one of a number possible sensors for detecting power consumption surges of motor 75. Power consumption surges occur because as frame 20 receives water through conduit 100, cavitation occurs in the liquid. Cavitation of the liquid refers to partial vacuums, or pockets of a gas, such as air, formed in the liquid, such as water. In the embodiment illustrated in FIG. 1, cavitation of the liquid originates from the action of pump 70 as conduit 100 provides liquid to frame 20; however, in the context of the invention, cavitation in a liquid, such as water, may be the result of any moving solid body in contact with the liquid. Pump 70 operates as liquid is provided to frame 20 and pumps the liquid to spray arm 40 for circulation or distribution. However, the amount of liquid provided to the frame is initially insufficient to fill sump 50, spray arm 40 and all of any other portions of a subsystem for circulating or distributing the liquid. Thus, in the embodiment illustrated in FIG. 1, after pump 70 has pumped substantially all of the liquid provided to frame 20, air enters the liquid distribution subsystem. This air produces cavitation in the liquid as the liquid circulates or is distributed in the machine. This cavitation, in turn, produces oscillations or surges in the power consumption of motor 75 because less power is consumed by motor 75 when air enters the liquid distribution subsystem.

Figure 2:
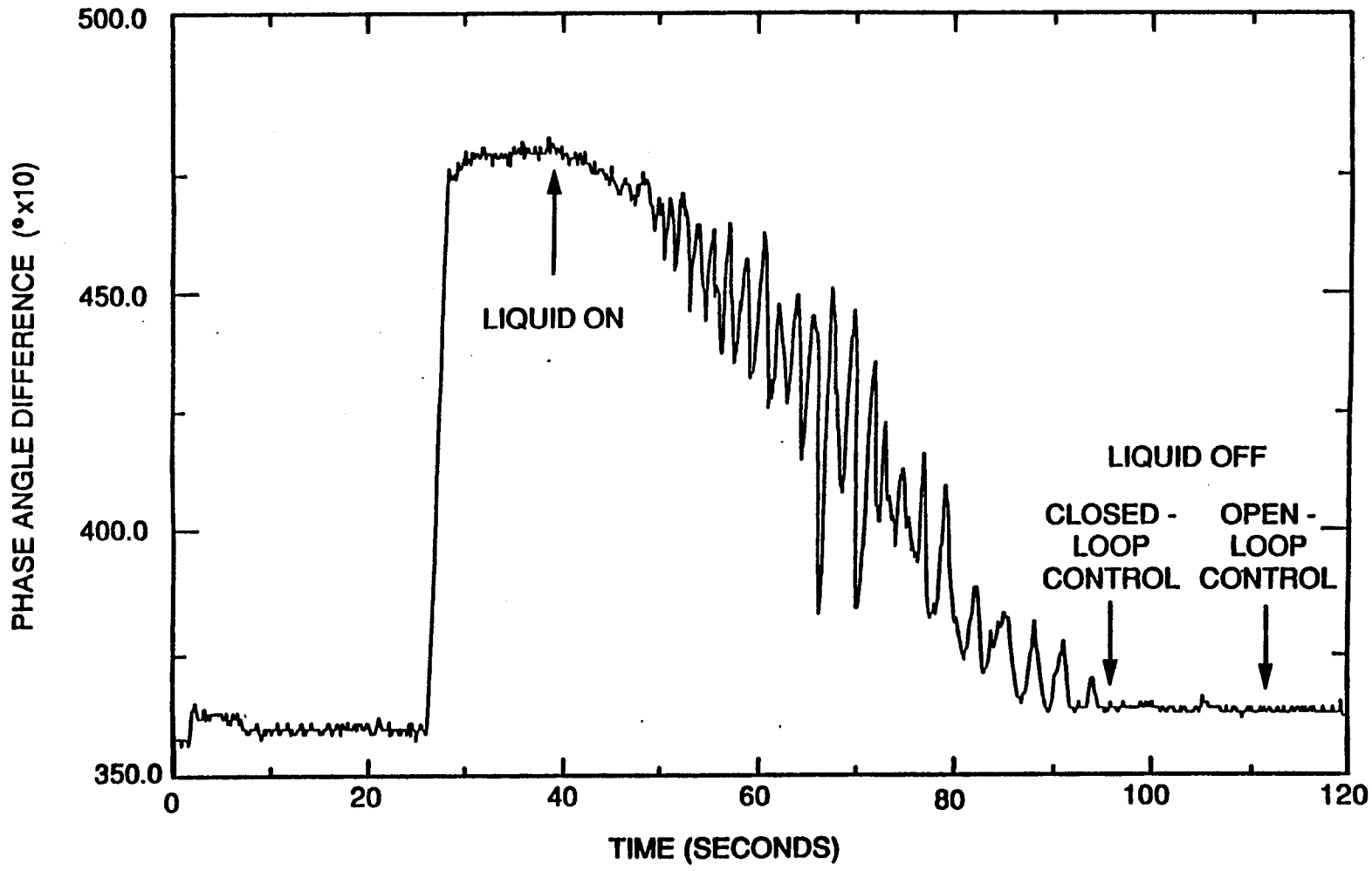
FIG. 2 is a plot of the magnitude of the difference in phase angle between motor current and motor voltage versus time for an embodiment of the invention illustrated in FIG. 1.

Cavitation of the liquid indicates that less than a sufficient amount has been received by frame 20 for that wash cycle. Oscillations or surges in the power consumption of motor 75 as frame 20 receives liquid are illustrated in FIG. 2. FIG. 2 is a plot of the output signal of one embodiment of a device for monitoring machine load for incorporation in a closed loop system for controlling machine load in accordance with the invention. As frame 20 continues to receive liquid, cavitation of the liquid and, hence, oscillations or surges in the power consumption of motor 75 begin to dampen. This occurs because gradually machine 10 receives an amount of liquid sufficient for that wash cycle. The number of articles contained in frame 20 may affect when a sufficient amount of liquid has been provided because the articles may absorb or entrap liquid, or liquid may adhere to the articles. Thus, a feedback control system in accordance with the invention has the capability to accommodate for the number of articles contained in the frame for a specific wash cycle. Likewise, a feedback control system in accordance with the invention accommodates for aging of the machine components, such as motor 75 or pump 70. Eventually, when a sufficient amount of liquid has been received by frame 20 for that wash cycle, cavitation of the liquid substantially diminishes or ceases. This occurs because pump 70 eventually receives a sufficient amount of liquid to pump liquid in a continuous stream. Likewise, oscillations or surges in the power consumption of motor 75 substantially dampen out or cease, as depicted in FIG. 2.

As illustrated in FIG. 1, device 60 receives one or more signals from motor 75 and provides one or more signals to controller 200. Depending upon the particular embodiment, device 60 may receive the same line voltage as motor 75, although such a configuration is not critical. Controller 200 may include electronic circuitry or, alternatively, a computer program incorporated in a microprocessor or other processor to adjust for the particular signal provided by device 60. For example, where device 60 comprises a sensor for measuring phase angle difference, as described hereinafter, controller 200 may comprise a conventional electronic circuit for performing analog integration or, alternatively, a microprocessor or other processor incorporating a computer program to count clock pulses of the processor clock.

FIG. 1 illustrates controller 200 receiving one or more signal inputs and providing one or more signal outputs. A signal input to controller 200 is a power consumption measurement provided by device 60 as frame 20 receives liquid. In particular, signals providing measurements for detecting power consumption surges of motor 75 correlated with cavitation of the liquid, as previously described, include measurements of motor speed, motor power, motor current, or motor phase angle difference, as described hereinafter. A number of other signals from machine 10, such as signals conveying information about progress of a washing or of a particular wash cycle, may also be provided to controller 200. Furthermore, a number of signal inputs may be provided by controller 200 to machine 10 for feedback control. Signal outputs provided by controller 200 include signals to machine 10 for controlling valve 30 to open and close conduit 100. Based upon other signals provided by controller 200, such as disclosed and described in aforesaid patent application Ser. No. 07/877,303 (RD-21,521), or alternatively based upon selections by the machine user, the number of wash cycles and the duration of those wash cycles may vary for a particular washing.

A number of possible embodiments exist for controller 200 and the invention is not limited to any particular embodiment. For example, controller 200 may comprise a closed loop feedback control system including a microprocessor, a microcontroller, an application specific integrated circuit (ASIC), a digital signal processor (DSP) or other processor. The microprocessor or other processor may incorporate a linear or non-linear closed loop feedback control algorithm. For example, the microprocessor or other processor may be programmed to implement a physically realizable frequency domain or time domain representation of a transfer function for a control system for a machine, such as a machine for cleansing articles. Alternatively, the closed loop feedback control system may comprise a microprocessor or other processor incorporating a fuzzy logic feedback control algorithm, such as disclosed in aforesaid patent application Ser. No. 07/877,301, (RD-22,082). The fuzzy logic feedback control algorithm, or any other appropriate linear or non-linear closed loop feedback control algorithm may control the opening and closing of conduit 100.

At the beginning of a wash cycle, frame 20 receives liquid by the opening of conduit 100. In the context of this invention, the opening and closing of conduit 100 or, alternatively, the duration for which liquid is provided to frame 20, defines the beginning of a wash cycle. A wash cycle comprises providing substantially particle-free liquid to the frame, circulating the liquid during the wash cycle, and draining or flushing the liquid from the frame after being used to wash the articles. A complete washing comprises washing the articles in one or more wash cycles until the articles are substantially free of particles. Nonetheless, a wash cycle may have other significant aspects, such as rinsing the articles, providing a rinsing agent, providing agents to clean, enhance cleaning, or assist in rinsing the articles, monitoring and adjusting the temperature of the liquid, or other aspects. Likewise, a wash cycle may include draining only a portion of the liquid used to wash the articles or providing only a portion of the substantially particle-free liquid sufficient for a wash cycle. Thus, depending upon the signals from controller 200, conduit 100 may be opened for a duration to provide only a portion of the sufficient amount of liquid. The former characterization of a wash cycle is not intended to exclude the latter aspects of a wash cycle.

A closed loop feedback control algorithm, such as the fuzzy logic feedback control algorithm disclosed in aforesaid patent application Ser. No. 07/877,301 (RD-22,082), may provide periodic, or discrete-time, closed loop feedback control for the system for washing or cleansing articles or it may provide continuous closed loop feedback control. In periodic feedback control, the closed loop feedback control system may incorporate, in real-time, sequences of measurements, such as several measurements per second, provided by the device for monitoring machine load. The closed loop feedback control algorithm uses the measurements to make determinations regarding the amount of liquid to provide to frame 20 or to determine when a sufficient amount has been provided. In contrast, the closed loop feedback control algorithm may provide continuous closed loop feedback control of machine load, such as for a machine for cleansing articles. Using a closed loop feedback control algorithm providing continuous closed loop feedback control, during a wash cycle the controller continuously receives signals during the wash cycle and based upon that information determines the appropriate point in time to open and close conduit 100 to provide a sufficient amount of liquid for that wash cycle.

In an alternative embodiment, controller 200 may comprise a closed loop feedback control system including electronic circuitry for determining when power consumption surges, and hence cavitation, has substantially dampened out or ceased. The electronic circuitry may incorporate analog electronic circuit components, digital electronic circuit components, or both. It will be appreciated by those skilled in the art that a multitude of possible electronic circuits may be designed and constructed to implement a multitude of possible closed loop feedback control systems. For example, an electronic circuit may be a physical realization of a frequency domain representation of a transfer function for a control system for a fluid-handling machine. A host of factors, including the particular type of machine, will affect the determination of the particular transfer function to be realized by the electronic circuitry used to implement it.

In a machine for cleansing articles, such as a dishwasher or clothes washer, controller 200 may comprise a closed loop feedback control system to control the washing or cleansing of articles in accordance with any turbidity measurements obtained, as disclosed in aforesaid patent application Ser. No. 07/877,303 (RD-21,521), any power consumption surges detected, any liquid pressure surges detected, as disclosed in aforesaid patent application Serial No. 07/877,353 (RD-21,353), or any combination thereof. Any of the previously described embodiments of a closed loop feedback control system may accomplish this, including a microprocessor or other processor, incorporating a closed loop feedback control algorithm, such as the fuzzy logic feedback control algorithms disclosed in aforesaid patent applications Ser. No. 07/877,302 (RD-22,061), and Ser. No. 07/877,301 (RD-22,082).

As described, a fuzzy logic controller may be used to control the amount of water to be provided to a machine for washing articles. One may determine when the machine has sufficient water by sensing the end of oscillations or surges in the power consumption of the motor. Several methods for sensing when the motor has ceased to surge are by measuring the pump motor current, pump motor current/voltage phase angle difference, motor speed, power and water pressure. Thus, a signal is available for determining when the pump motor has ceased to surge. In a method for using the features of this signal, the amplitude of oscillation and slope of the average signal is used to determine the end of motor surge. A third variable, elapsed time, is also used to ensure that the water is not shut off prematurely due to system noise very early in the fill operation.

One embodiment of the sensor for detecting power consumption surges included in device 60 comprises a sensor that measures the magnitude of the difference in phase angle between the alternating current of motor 75 and the alternating voltage of motor 75. For an ideal electric motor operating with alternating current, when the motor has no load across it or when the motor performs substantially no work, the alternating current of the motor should lag the alternating voltage of the motor by a phase angle difference approaching 90°. Likewise, when the motor is performing its maximum amount of work, such as when it is operating at full design capacity, the current of the motor and the voltage of the motor should be substantially in phase. Thus, measuring the magnitude of the phase angle difference between the current and voltage of the motor is one method of detecting the power consumption of the motor and, thus, monitoring machine load. FIG. 2 is a plot of the magnitude of the difference in phase angle for the voltage of motor 75 and the current of motor 75 as machine 10 receives liquid. Soon after motor 75 receives power, the phase angle difference is between 45 and 50 degrees. The phase angle difference diminishes to between 35 and 40 degrees once machine 10 has received a sufficient amount of liquid for the wash cycle. Thus, by sensing when the oscillations or surges in the power consumption of motor 75 have substantially dampened out or ceased, the appropriate time to no longer provide liquid, such as by closing conduit 100, may be determined to ensure that a sufficient, but not excessive, amount of liquid for the wash cycle has been provided.

One embodiment of such a sensor for measuring the phase angle difference comprises a voltage probe coupled to motor 75 to measure voltage and a Tektronix current probe coupled to motor 75 to measure current. In the embodiment of the sensor for measuring phase angle difference including a voltage probe and a current probe, the signal from each respective probe is separately provided to an electronic circuit, such as a conventional comparator or an operational amplifier, for providing a digital output signal, such as a positive step signal, when the particular signal, such as the alternating current or alternating voltage, has a positive voltage. Likewise, another digital output signal, such as a negative voltage or ground, is provided when the particular signal has a negative voltage. Both respective comparator or operational amplifier output signals are then simultaneously provided to another electronic circuit, such as a conventional flip-flop or an AND function gate, to provide a digital output signal to indicate the duration in which both comparator or operational amplifier output signals have a positive voltage. This duration provides a measurement of the phase angle difference between the current and voltage of motor 75.

Another embodiment of a sensor for measuring phase angle difference is disclosed in aforesaid patent application Ser. No. 07/877,305 (RD-21,519). It will be appreciated that a sensor for measuring phase angle difference may comprise a number of other embodiments and the invention is not restricted to any particular embodiment.

Figure 3:
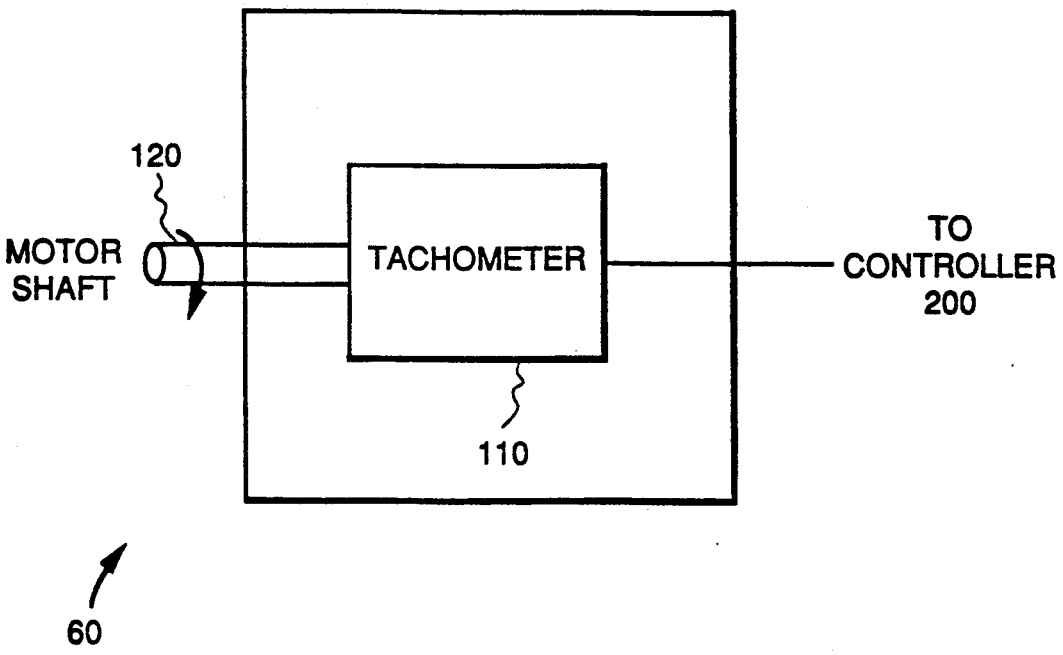
FIGS. 3 to 5 are schematic diagrams of alternative embodiments of a device for monitoring machine load for incorporation in a closed loop system for controlling machine load in accordance with the invention.

Still another embodiment of the sensor for detecting power consumption surges may comprise a sensor for measuring the speed of a rotor connected to motor 75. In an asynchronous electric motor, rotor speed provides a measurement of motor load. A conventional tachometer or other speed transducer coupled to the rotor by motor shaft 120, illustrated in FIG. 3, would provide satisfactory measurements of rotor speed. As illustrated in FIG. 3, tachometer 110 may be coupled to controller 200. Likewise, a sensor may instead measure the change in rotor speed.

Figure 4:
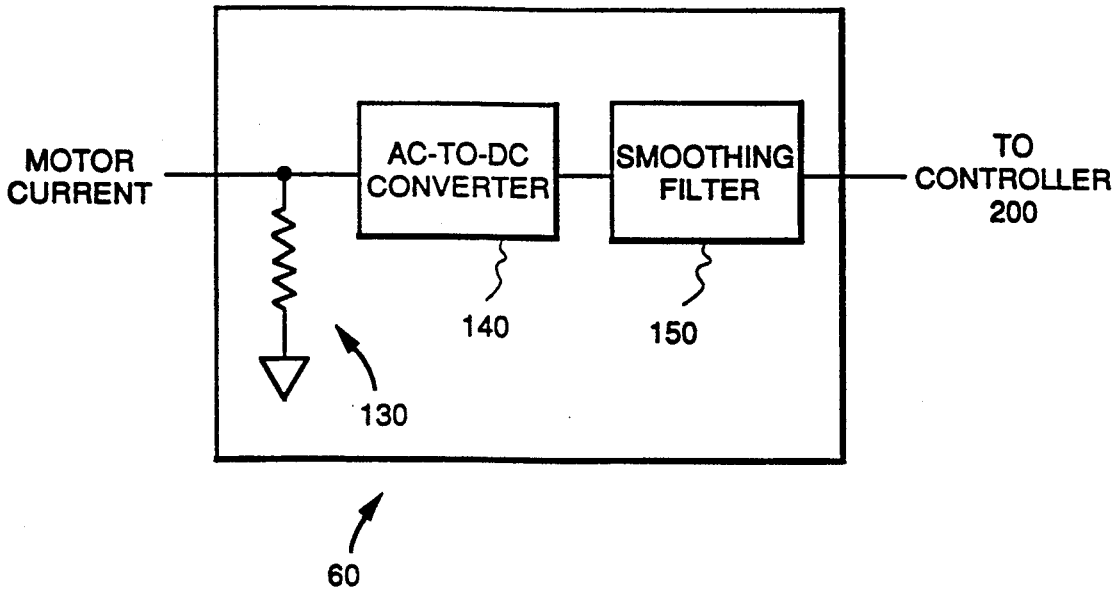

In an alternative embodiment of the sensor for detecting power consumption surges, a sensor for detecting either the peak current of motor 75 or the root-mean-square value of the current for motor 75 would detect such power consumption surges. One embodiment of such a current sensor, as illustrated in FIG. 4, includes a resistor 130 of a predetermined resistive value that is small relative to the current. The voltage across such a resistor is coupled to controller 200 through a conventional AC-to--DC converter 140 and a conventional smoothing filter 150, to provide a measurement of the motor current. Likewise, a sensor may instead measure the change in current.

Figure 5:
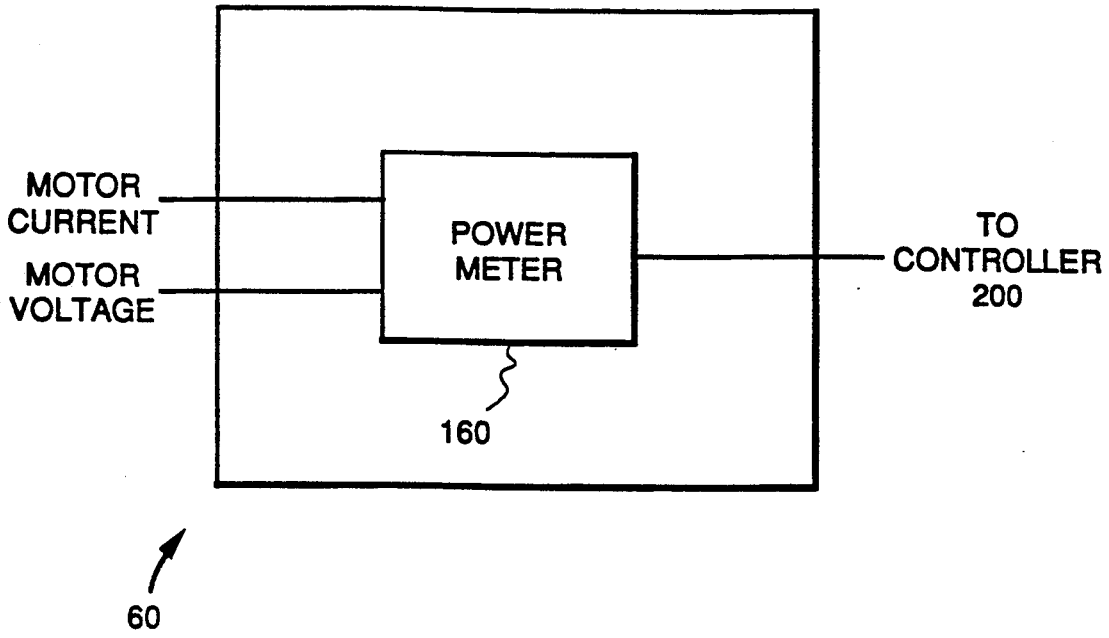

In yet another embodiment of the sensor for detecting power consumption surges, the power of motor 75 may be measured substantially instantaneously. For example, as illustrated in FIG. 5, signals from motor 75 of current and voltage, as previously described, may be provided to powermeter 160, such as an RFL Industries, Inc., multi-function power analyzer. Likewise, a sensor may instead measure the substantially instantaneous change in power.

An additional feature of a machine incorporating a closed loop system for controlling machine load in accordance with the present invention includes the capability to store information regarding previous wash cycles. For example, in a machine for cleansing articles, this information may be used by the closed loop feedback control system to make future determinations regarding the amount of liquid to provide to the machine for a wash cycle. This information may be used to take into account factors such as changes in liquid pressure, aging of machine components, deterioration of the sensor for detecting power consumption surges, and other factors.

A machine incorporating a closed loop system for controlling machine load in accordance with the present invention may be operated according to the following method. A liquid, such as water, may be provided to machine 10 illustrated in FIG. 1 through conduit 100. As machine 10 receives liquid, the liquid is circulated or distributed by the liquid circulation or distribution subsystem, such as by spray arm 40 connected to pump 70. Power consumption surges of motor 75 are detected as machine 10 continues to receive liquid through conduit 100. The amount of liquid provided to machine 10 is controlled in accordance with the detected power consumption surges. In particular, the amount of liquid provided to the machine is controlled so that the power consumption surges substantially dampen out or cease, as previously described. Once the power consumption surges have substantially dampened or ceased, liquid is no longer provided to machine 10. For example, conduit 100 is closed. In one embodiment of the invention, conduit 100 is closed by no longer providing power to a solenoid for actuating valve 30, as shown in FIG. 1. In this embodiment, valve 30 may normally be in a position to close conduit 100. Thus, the conduit closes when the solenoid is no longer actuated.

Controller 200 controls the amount of liquid provided to machine 10. For example, in an embodiment of the invention in which controller 200 comprises a microprocessor or other processor incorporating a fuzzy logic feedback control algorithm, such as disclosed in aforesaid patent application Ser. No. 07/877,301 (RD-22,082), the fuzzy logic feedback control algorithm monitors three fuzzy variables: time, amplitude, and slope. The algorithm disclosed in the aforesaid patent application uses these variables to determine the corresponding value of a fuzzy logic control variable. The algorithm then uses a defuzzification method, such as centroid defuzzification, to determine the appropriate time to close conduit 100. Alternatively, a fuzzy logic control algorithm may determine the duration of keeping conduit 100 open to provide a sufficient amount of liquid to machine 10 for the wash cycle. It will be appreciated, however, that the invention is not limited in scope to this particular fuzzy logic feedback control algorithm or to any particular closed loop feedback control algorithm, whether incorporating a fuzzy logic control strategy or a linear or other non-linear control strategy.

In the method described above, detecting power consumption surges in an apparatus driving a liquid circulation or distribution subsystem for the machine, such as motor 75 in pump 70, comprises several alternative embodiments. In one embodiment, detecting power consumption surges comprises measuring the current of the motor, or any changes thereof. In an alternative embodiment, detecting power consumption surges comprises measuring the speed of a rotor connected to the motor, or any changes thereof. In still another embodiment, detecting power consumption surges comprises measuring the magnitude of the phase angle difference between the alternating current of the motor and the alternating voltage of the motor, or any changes thereof.

While only certain features of the invention have been illustrated and described herein, many modifications, substitutions, changes, and equivalents will now occur to those skilled in the art. For example, a closed loop system for controlling machine load incorporated in a machine for cleansing articles may be used to control other aspects of a washing or wash cycle. Likewise, a closed loop system for controlling machine load in accordance with the present invention may be useful in machines other than those for cleansing articles. It is, therefore, to be understood that the appended claims are intended to cover all such modifications and changes as fall within the true spirit of the invention.

What is claimed is:

1. A dishwasher for cleansing food handling items with a liquid comprising:

a frame for containing food handling items to be cleansed;

means for providing a liquid to said frame;

a circulation pump for distributing said liquid in said frame;

a motor coupled to said pump;

a sensor for detecting power consumption surges in said motor as said frame receives said liquid; and a controller, responsive to said sensor, for controlling said liquid providing means, said controller comprising a microprocessor incorporating a fuzzy-logic feedback control algorithm adapted to process an elapsed time for distributing said liquid, an amplitude of the power consumption surges and an average slope of the power consumption surges to control said liquid providing means.

2. The machine of claim 1, wherein said motor includes a rotor;

said sensor for detecting power consumption surges being capable of measuring the speed of said rotor.

3. The machine of claim 2, wherein said sensor comprises a tachometer.

4. The machine of claim 1, wherein said motor includes a rotor;

said sensor for detecting power consumption surges being capable of measuring the change in speed of said rotor.

5. The machine of claim 3, wherein said motor comprises an alternating current motor having an alternating voltage with a first phase in which the alternating current has a second phase;

said sensor for detecting power consumption surges being capable of measuring the magnitude of the difference between said first phase and said second phase.

6. The machine of claim 1, wherein said motor comprises an alternating current motor;

said sensor for detecting power consumption surges being capable of measuring alternating current in said motor.

7. The machine of claim 1, wherein said liquid providing means comprises a conduit connected to said frame, said conduit including a valve for opening and closing said conduit in response to said controller.

8. The machine of claim 7, wherein said valve comprises a solenoidal-driven valve responsive to said controller.

9. The machine of claim 1, wherein said liquid providing means comprises a conduit connected to said frame, said conduit including a valve;

said controller being adapted to control said valve in response to said sensor so as to close said conduit after said frame has received a sufficient amount of liquid for a wash cycle.

10. A method for cleansing food handling items with a dishwasher including power utilization means for circulating liquid in said dishwasher, said method comprising the steps of:

(a) providing said liquid to said dishwasher;

(b) circulating aid liquid in said dishwasher as said dishwasher receives said liquid;

(c) detecting power consumption surges in said power utilization means as said dishwasher receives said liquid; and (d) controlling the amount of said liquid provided to said dishwasher in accordance with the detected power consumption surges based upon a fuzzy-logic feedback control algorithm, said algorithm including the step of processing an elapsed time for distributing said liquid, an amplitude of the power consumption surges, and an average slope of the power consumption surges.

11. The method of claim 10, wherein said power utilization means comprises an alternating current electric motor driveably coupled to a pump; and the step of detecting power consumption surges comprising the step of measuring the current of said motor.

12. The method of claim 10, wherein said power utilization means comprises a motor driveably coupled to a pump, said motor including a rotor; and the step of detecting power consumption surges comprising the step of measuring the speed of said rotor.

13. The method of claim 10, wherein said power utilization means comprises a motor driveably coupled to a pump, said motor including a rotor; and the step of detecting power consumption surges comprising the step of measuring changes in the speed of said rotor.

14. The method of claim 10, wherein said power utilization means comprises an alternating current electric motor driveably coupled to a pump, said motor having an alternating voltage of different phase than said current; and the step of detecting power consumption surges comprising the step of measuring the magnitude of the difference between the alternating current and alternating voltage phases.

* * * * *